US008162159B2

(12) United States Patent
Carter

(10) Patent No.: US 8,162,159 B2
(45) Date of Patent: Apr. 24, 2012

(54) MODULAR GARAGE STORAGE

(76) Inventor: Mark C. Carter, Murieta, CA (US)

( * ) Notice: Subject to any disclaimer, the term of this patent is extended or adjusted under 35 U.S.C. 154(b) by 226 days.

(21) Appl. No.: 12/061,593

(22) Filed: Apr. 2, 2008

(65) Prior Publication Data

US 2008/0245755 A1 Oct. 9, 2008

Related U.S. Application Data

(60) Provisional application No. 60/921,739, filed on Apr. 4, 2007.

(51) Int. Cl.
*A47F 5/08* (2006.01)

(52) U.S. Cl. ..... 211/117; 108/145; 254/122; 254/124; 182/141; 182/142

(58) Field of Classification Search ..... 211/113, 211/117, 175, 150, 1.57; 248/317, 323, 336, 248/327; 52/27, 39; 108/42, 145, 149; 187/269; 312/247, 306, 312; 182/141, 142, 143, 144, 182/150; 254/122, 124; 269/60, 71, 37
See application file for complete search history.

(56) References Cited

U.S. PATENT DOCUMENTS 530,120 A * 12/1894 Oakley ..... 182/116
636,445 A * 11/1899 McCabe ..... 187/269
1,031,818 A * 7/1912 Putman ..... 182/116
1,352,352 A * 9/1920 Caswell ..... 126/337 A
1,663,297 A * 3/1928 Fruehauf ..... 211/117
1,819,516 A * 8/1931 Kelly ..... 296/37.7
2,284,531 A * 5/1942 Miller et al. ..... 312/310
2,581,023 A * 1/1952 Jerick ..... 108/4
2,617,547 A * 11/1952 Pridy ..... 414/746.2
2,641,247 A * 6/1953 Genebach ..... 126/337 A
2,706,102 A * 4/1955 Cresci ..... 254/8 C
2,931,519 A * 4/1960 Beach ..... 414/589
3,036,865 A * 5/1962 Stone ..... 298/11
3,141,178 A * 7/1964 Campbell ..... 5/118
3,228,659 A * 1/1966 Sturm ..... 254/122
3,410,328 A * 11/1968 Sasai ..... 220/9.2
3,556,320 A * 1/1971 Henderson et al. ..... 52/30
3,623,168 A * 11/1971 Rouch ..... 5/10.1
RE27,914 E * 2/1974 King ..... 182/16
3,829,912 A * 8/1974 Quakenbrush ..... 5/10.2
4,029,297 A * 6/1977 Mounsdon ..... 254/286
4,249,749 A * 2/1981 Collier ..... 280/35
4,405,116 A * 9/1983 Eisenberg ..... 254/122
4,792,110 A * 12/1988 Bond ..... 248/651
5,058,846 A 10/1991 Close
5,224,677 A 7/1993 Close
5,239,795 A * 8/1993 Breaux ..... 52/182
5,261,645 A * 11/1993 Huffman ..... 254/267
5,366,203 A * 11/1994 Huffman ..... 254/362
5,475,949 A * 12/1995 McCoy ..... 52/67

(Continued)

FOREIGN PATENT DOCUMENTS

EP 0156026 A2 10/1984

*Primary Examiner* — Darnell Jayne
*Assistant Examiner* — Devin Barnett
(74) *Attorney, Agent, or Firm* — Fulwider Patton LLP

(57) ABSTRACT

The modular garage storage system includes a geared retraction system that allows a storage platform of the modular garage storage system to be lowered for easy access to loading and loading the storage platform, and that allows the storage platform to be raised up to be completely out of the way.

6 Claims, 1 Drawing Sheet

U.S. PATENT DOCUMENTS 5,503,368 A * 4/1996 Torres ..... 254/88
5,535,852 A * 7/1996 Bishop et al. ..... 187/336
5,794,793 A * 8/1998 Frederick ..... 211/20
5,971,170 A * 10/1999 Livingston ..... 211/116
6,045,122 A * 4/2000 Torres ..... 254/88
6,161,702 A * 12/2000 Campbell ..... 211/17
6,216,993 B1 4/2001 Morris
6,231,114 B1 * 5/2001 Warmoth ..... 296/170
6,345,799 B1 * 2/2002 Fusi ..... 248/320
6,431,319 B1 * 8/2002 Myers et al. ..... 187/243
6,637,711 B2 * 10/2003 Enochs ..... 248/327
6,725,608 B1 4/2004 Kraus
6,779,635 B1 * 8/2004 Anibas ..... 187/269
6,851,376 B2 * 2/2005 D'Agostino ..... 108/42
7,093,691 B1 * 8/2006 Vaughan et al. ..... 187/269
7,111,825 B2 * 9/2006 Landsberger et al. ..... 254/126
7,413,056 B2 * 8/2008 Gonzi et al. ..... 187/269
7,802,840 B1 * 9/2010 Shea ..... 296/190.02
8,015,638 B2 * 9/2011 Shimada et al. ..... 5/611
2003/0168646 A1 * 9/2003 Lopez Alba ..... 254/122
2007/0029267 A1 * 2/2007 Hall et al. ..... 211/17

* cited by examiner

MODULAR GARAGE STORAGE

CROSS-REFERENCES TO RELATED APPLICATIONS

This application is based upon Provisional Application No. 60/921,739, filed Apr. 4, 2007.

BACKGROUND OF THE INVENTION

The present invention relates to a movable storage system, and more particularly relates to a movable, modular storage system that attaches to the ceiling in a garage. The modular storage system can be lowered for easy access to items to be stored or removed from the storage system, and can be raised up by using a retraction system.

One conventional storage assembly that provides storage space below a garage ceiling includes metal ties extending through apertures of a ceiling panel and apertures of ceiling catching beams extending perpendicularly over rafters of the garage. Fasteners are attached to upper ends of the metal ties to secure the metal ties to the ceiling catching beams, and the lower ends of the metal ties extend to support shelf catching beams, and a shelf panel overlies the shelf catching beams. However, this type of storage assembly is not adjustable or movable between a lowered position and a raised position.

Another type of modular storage system includes a support rail mounted on a wall or ceiling, in a horizontal or vertical orientation, with slidably adjustable cantilevered hooks. Storage boxes fitted with a frame on the open side and a transparent hinged door may be hung from the hooks. While the position of the hooks can be adjusted, this type of storage system is also not readily movable between a lowered position for easy access to items to be stored or removed and a raised position for storage of the items in the storage assembly.

A pull-down display and storage device is known that is movable with respect to a fixed support having pivot apparatus interconnected between the fixed support and the movable member. The device may be lowered by pulling the device out and down from the fixed support, and balanced movement of the device is controlled by one or more springs. An assembly of pull-down, retractable stairs is also known, that is typically attached to a ceiling, and can be pulled down for access to an attic, and retracted so that the stairs assembly takes up little space below a ceiling. However, such pull-down assemblies typically will not support a load that is greater than is necessary to pull them down for access.

There is a need for a movable, modular storage system that attaches to the ceiling in a garage so that the modular storage system can be lowered for easy access to items to be stored or removed from the storage system and can be raised up by a retraction system that can support a load. The present invention fulfills these and other needs.

SUMMARY OF THE INVENTION

Briefly, and in general terms, the present invention provides for a modular garage storage system for a ceiling structure of a building having a geared retraction system that allows a storage platform of the modular garage storage system to be lowered for easy access to loading and loading the storage platform, and that allows the storage platform to be raised up to be completely out of the way.

In a presently preferred aspect, the modular garage storage system includes left and right side upper support rails adapted to be mounted to the ceiling structure of a building, a storage platform having a storage chamber, a front opening, a rear portion, left and right sides, and a base including left and right side lower support rails. The storage platform is supported by left and right side truss pairs of link members from upper support rails. The left side truss pair of link members has an upper end connected to a left side upper support rail, and a lower end connected to the left side lower support rail, and the right side truss pair of link members has an upper end connected to a right side upper support rail, and a lower end connected to the right side lower support rail. A geared retraction system is connected between the upper ends of one of the left and right side truss pairs of link member at one of the left and right side upper support rails for raising and lowering the storage platform. In one presently preferred aspect, the storage platform includes a left upright side wall, a rear upright side wall, and a right upright side wall joined to the base. In another aspect, the left side lower support rail is located on the inside of the left side wall, and the right side lower support rail is located on the inside of the right side wall.

In another presently preferred aspect, the left side truss pair of link members includes a first link member having upper and lower ends and a second link member having upper and lower ends. The first and second link members are pivotally connected at a central pivot point, the upper end of the first link member of the left side truss pair is slidably and pivotally connected to the left side upper support rail, and the lower end of the first link members of the left side truss pair is pivotally connected to the left side lower support rail. Similarly, the right side truss pair of link members includes a first link member having upper and lower ends, and a second link member having upper and lower ends. The first and second link members are pivotally connected together at a central pivot point, the upper end of the first link member of the right side truss pair is slidably and pivotally connected to the right side upper support rail, and the lower end of the first link member of the right side truss pair is pivotally connected to the right side lower support rail.

In another presently preferred aspect, the upper end of the first link member of the left side truss pair of link members is slidably and pivotally connected by a slider to the left side upper support rail, the lower end of the first link member of the left side truss pair of link members is pivotally connected to the left side lower support rail, the upper end of the first link member of the right side truss pair of link members is slidably and pivotally connected by a slider to the right side upper support rail, and the lower end of the first link members of the right side truss pair of link members is pivotally connected to the right side lower support rail.

The geared retraction system typically includes a housing and a rotatable crank that can be rotated clockwise and counterclockwise to move the storage platform between a lowered position and a raised position, and a handle is removably connectable to the crank for operation of the geared retraction system.

These and other forms of the invention will become apparent from a consideration of the following detailed description and from the accompanying drawings.

DETAILED DESCRIPTION OF THE PREFERRED EMBODIMENTS

Figure 1:
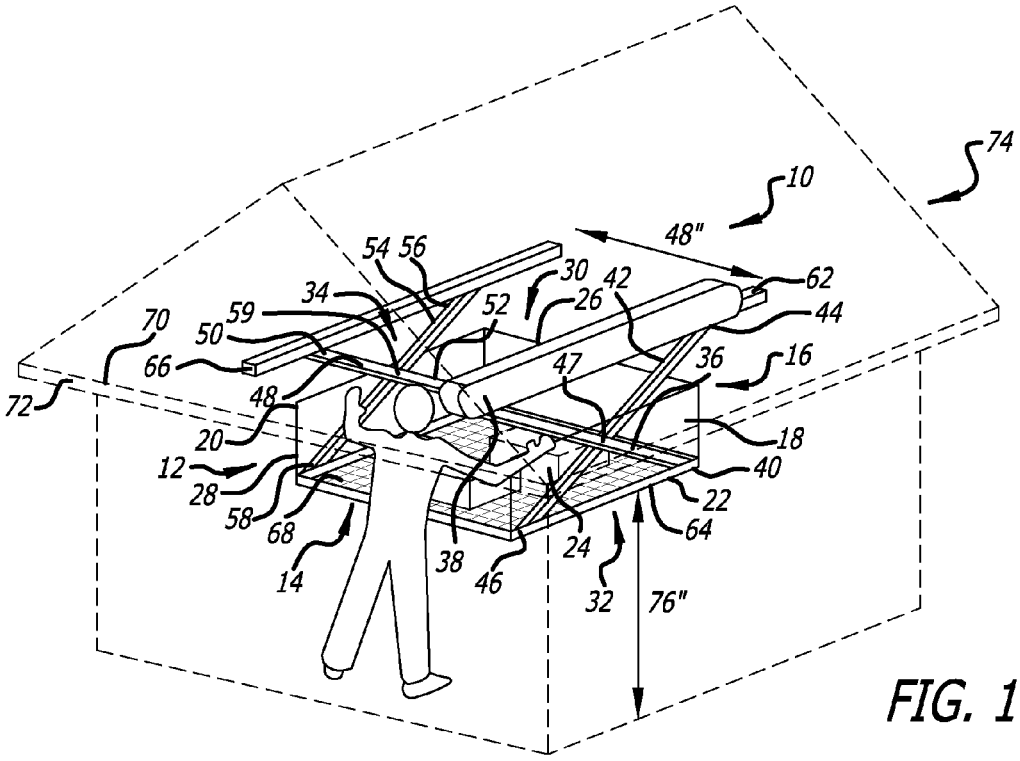
FIG. 1 is a schematic perspective diagram of the modular garage storage system of the invention installed in a ceiling of a garage, showing the modular garage storage system in a lowered position.

The modular garage storage system 10 is typically formed of metal, and includes a storage platform 12 having front opening 14, a rear portion 16, a left side 18 and a right side 20, a horizontal base 22, and at least three upright side walls joined to the base, including a left side wall 24, a rear side wall 26, and a right side wall 28 defining a storage chamber 30.

Left side and right side truss pairs 32, 34 of link members are connected to the left and right sides of the storage platform. The left side truss pair includes a first link member 36 having an upper end 38 and a lower end 40, and a second link member 42 having an upper end 44 and a lower end 46. The first and second link members of the left side truss pair are pivotally connected together at a central pivot point 47. The right side truss pair similarly includes a first link member 48 having an upper end 50 and a lower end 52, and a second link member 54 having an upper end 56 and a lower end 58. The first and second link members of the right side truss pair are pivotally connected together at a central pivot point 59.

The upper end of the first link member of the left side truss pair is slidably and pivotally connected by a slider 60 to a left side upper support rail 62, and the lower end of the first link member of the left side truss pair is pivotally connected by a bracket 61 to a left side lower support rail 64 on the left side of the storage platform. The upper end 44 of the second link member 42 is pivotally connected by a bracket 61 to the left side upper support rail, and the lower end 46 of the second link member 42 is slidably and pivotally connected by a slider to the left side lower support rail. Similarly the upper end 50 of the first link member 48 of the right side truss pair is slidably and pivotally connected by a slider to a right side upper support rail 66, and the lower end of the first link member of the right side truss pair is pivotally connected by a bracket to a right side lower support rail 68 on the right side of the storage platform. Similarly, the upper end 56 of the second link member 54 of the right side truss pair is pivotally connected by a bracket 61 to the right side upper support rail, and the lower end 58 of the second link member 54 of the right side truss pair is slidably and pivotally connected by a slider to the right side lower support rail. Typically, the left side lower support rail is located on the inside of the left side wall, and the right side lower support rail is located on the inside of the right side wall. The left and right side upper support rails are preferably mounted to ceiling joists 70 of a ceiling 72 of a building such as a garage 74, for example.

Figure 2:
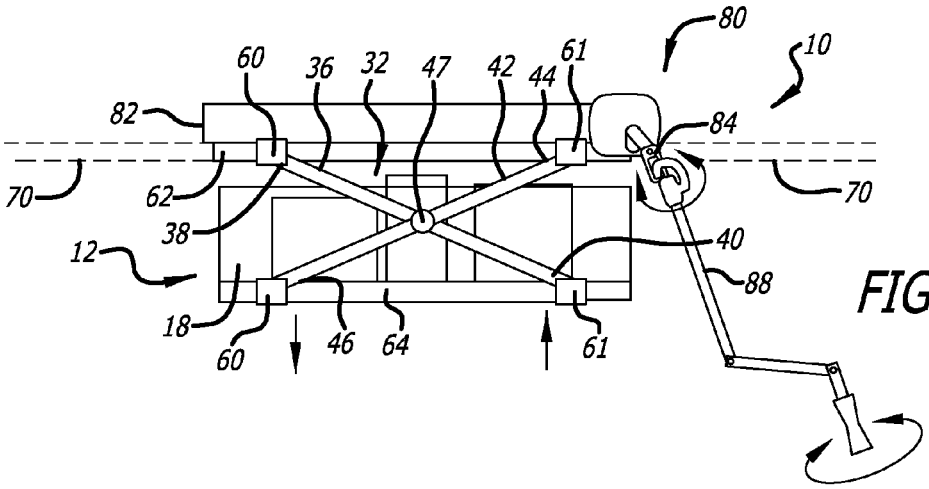
FIG. 2 is a front view of the modular garage storage system of FIG. 1, illustrating movement of the modular garage storage system between a lowered position and a raised position by a removable handle.
Figure 3:
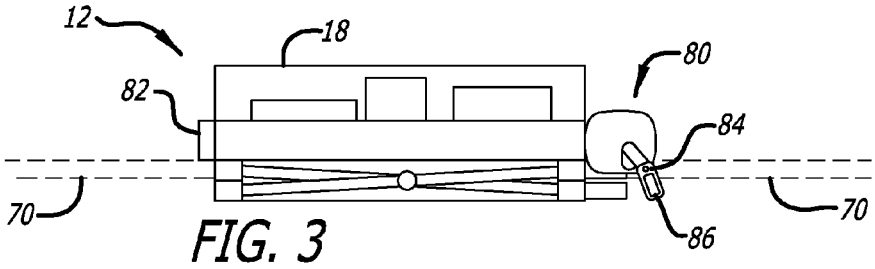
FIG. 3 is a front view of the modular garage storage system of FIG. 1, illustrating the modular garage storage system in a raised position.

A geared retraction system 80 is connected to the sliders at one of the upper support rails, such as the left side upper support rail as is illustrated, for example. The geared retraction system includes a housing 82, including a rotatable crank 84 for operating an internal drive mechanism connected to the slider 60 and bracket 61 connected to the upper ends of the first and second link members of the left side truss pair of link members to move the storage platform between a lowered position, illustrated in FIGS. 1 and 2, and a raised position, illustrated in FIG. 3. The rotatable crank typically includes a loop or hook portion 86 to which a removable handle, such as an articulated rotable removable handle 88, may be attached for operation of the geared retraction system. As is illustrated in FIG. 2, the handle and crank can be rotated clockwise and counterclockwise to move the storage platform between the lowered position and the raised position.

The modular garage storage system typically holds at least a 200-lb. payload, and is typically constructed in four foot by four foot sections with a storage platform approximately 18 inches deep, to provide approximately 24 cubic feet of storage. When mounted to a standard garage ceiling approximately eight feet above a floor, and when the storage platform is lowered, the modular garage storage system typically provides approximately 76 inches of under storage clearance.

It will be apparent from the foregoing that, while particular forms of the invention have been illustrated and described, various modifications can be made without departing from the spirit and scope of the invention. Accordingly, it is not intended that the invention be limited, except as by the appended claims.

The invention claimed is:

1. A modular storage system for a ceiling structure of a building, comprising:

a storage platform having a storage chamber, a front opening, a rear portion, left and right sides, and a base including left and right side lower support rails, said left side lower support rail including a left side lower support rail slider slidably connected to said left side lower support rail and a left side lower support rail bracket connected to said left side lower support rail, and said right side lower support rail including a right side lower support rail slider slidably connected to said right side lower support rail and a right side lower support rail bracket connected to said right side lower support rail;

a left side upper support rail mounted to the ceiling structure of a building, said left side upper support rail including a left side upper support rail slider slidably connected to said left side upper support rail and a left side upper support rail bracket connected to said left side upper support rail;

a right side upper support rail mounted to the ceiling structure of the building, said right side upper support rail including a right side upper support rail slider slidably connected to said right side upper support rail and a right side upper support rail bracket connected to said right side upper support rail;

a left side truss pair of link members including first and second link members each having upper and lower ends, said upper end of said first link member being pivotally connected to said left side upper support rail slider, said lower end of said first link member being pivotally connected to said left side lower support rail bracket, said upper end of said second link member being pivotally connected to said left side upper support rail bracket, and said lower end of said second link member being pivotally connected to said left side lower support rail bracket;

a right side truss pair of link members including first and second link members each having upper and lower ends, said upper end of said first link member being pivotally connected to said right side upper support rail slider, said lower end of said first link member being pivotally connected to said right side lower support rail bracket, said upper end of said second link member being pivotally connected to said right side upper support rail bracket, and said lower end of said second link member being pivotally connected to said right side lower support rail bracket; and a retraction system configured to move said storage platform between a lowered position and a raised position, said retraction system including a housing, a drive mechanism in said housing connected between one of said left and right side upper support rail sliders and a corresponding one of said left and right side upper support rail brackets, and a rotatable crank connected to said drive mechanism and configured to operate said drive mechanism to move said storage platform between said lowered position and said raised position; wherein said rotatable crank is configured to be rotated clockwise and counterclockwise to move the storage platform between said lowered position and said raised position; wherein a handle is removably connectable to said rotatable crank; wherein said rotatable crank is configured to be rotated clockwise and counterclockwise to move the storage platform between said lowered position and said raised position; wherein a handle is removably connectable to said rotatable crank.

2. The modular storage system of claim 1, wherein said rotatable crank comprises a loop portion to which said handle is removably connectable.

3. The modular storage system of claim 1, wherein the left side lower support rail is located on the inside of the left side wall.

4. The modular storage system of claim 1, wherein the right side lower support rail is located on an inside of the right side wall.

5. The modular storage system of claim 1, wherein said first and second link members of said left side truss pair of link members are pivotally connected together at a central pivot point.

6. The modular storage system of claim 1, wherein said first and second link members of said right side truss pair of link members are pivotally connected together at a central pivot point.

* * * * *